United States Patent [19]

Christ et al.

[11] Patent Number: 5,052,581

[45] Date of Patent: Oct. 1, 1991

[54] LADDER-SUPPORTED HOLDING TRAY

[75] Inventors: Joseph T. Christ; Helen M. Christ, both of Dyer, Ind.

[73] Assignee: Craft Creations Co., Inc., Dyer, Ind.

[21] Appl. No.: 566,117

[22] Filed: Aug. 13, 1990

[51] Int. Cl.[5] ..... E06C 7/14; A47L 13/56

[52] U.S. Cl. ..... 220/570; 15/257.06; 182/121; 248/211

[58] Field of Search ..... 248/210, 211, 238; 182/121; 15/257.06; 220/570

[56] References Cited

U.S. PATENT DOCUMENTS

| | | | |
|---|---|---|---|
| 606,763 | 7/1898 | Lukens | 182/121 |
| 2,694,825 | 11/1954 | Touchett et al. | 248/211 X |
| 2,759,620 | 8/1956 | Pharris | 15/257.06 |
| 3,009,677 | 11/1961 | Munnikhuysen | 248/210 X |
| 3,052,442 | 9/1962 | Rankin, Jr. | 248/210 |
| 3,100,313 | 8/1963 | Ernst | 15/257.06 |
| 3,157,902 | 11/1964 | Hardwick | 15/257.06 |
| 3,474,996 | 10/1969 | Stamm | 248/210 |
| 3,625,388 | 12/1971 | Golden et al. | 220/570 |
| 3,707,242 | 12/1972 | Golden et al. | 270/570 |
| 3,940,824 | 3/1976 | Gioia et al. | 15/257.206 |
| 4,261,435 | 4/1981 | Winter | 182/121 X |

*Primary Examiner*—Bryon P. Gehman

*Attorney, Agent, or Firm*—Marshall, O'Toole, Gerstein, Murray & Bicknell

[57] ABSTRACT

A support tray for a ladder, scaffold and the like that includes a load-bearing support bar or strut that is secured to ladder structure below the tray and includes means for adjusting the length of the support bar to maintain the tray in a substantially horizontal disposition for supporting paint containers, tools and the like regardless of the particular ladder step spacing or its angle of disposition at the workplace. The support tray is detachable and adapted to be secured to and removed from a ladder and adapted to support tools, paint containers on a substantially planar floor member and integral upstanding walls. A tray member securing device of clamp is operatively connected to the tray member for securing the tray member to the ladder in a horizontal position at a predetermined height of the ladder.

16 Claims, 2 Drawing Sheets

FIG. 5
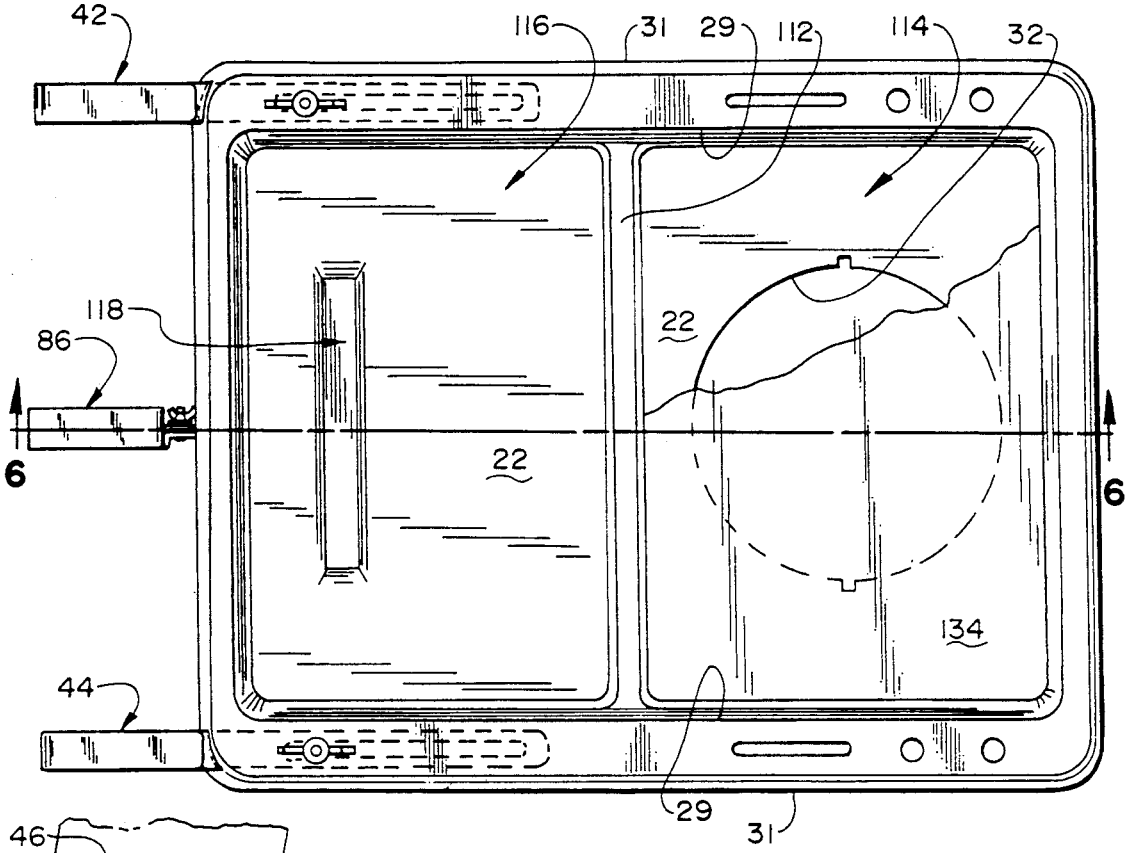
FIG. 6
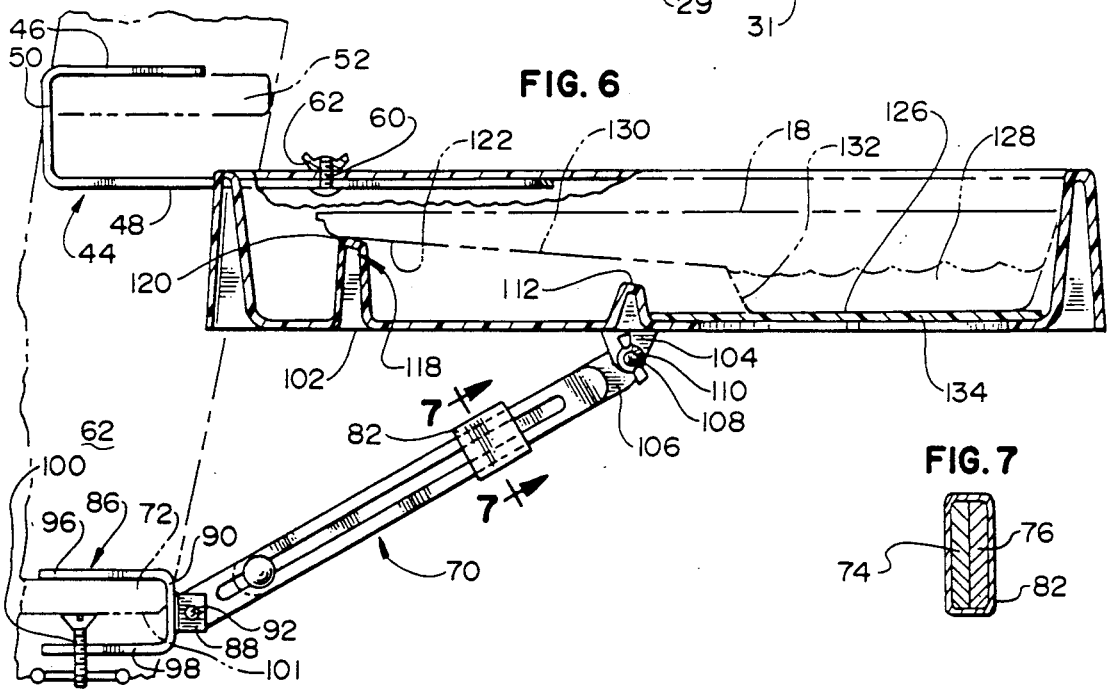
FIG. 7

LADDER-SUPPORTED HOLDING TRAY

FIELD OF THE INVENTION

The present invention is directed to a support tray that can be removably attached to a ladder, scaffold and the like to extend outwardly from the ladder for holding tools, paint containers and other devices in a horizontal position that is convenient to the ladder user. More particularly, the present invention is directed to a ladder support tray that is removably secured to the ladder at one tray end disposed adjacent to the ladder, and the tray includes an adjustable load-bearing support bar or strut pivotally secured to the tray at one or more locations spaced from the ladder-adjacent end of the tray, and removably secured to the ladder at one or more locations spaced below the tray, to support substantial loads on the tray, such as paint containers, drills and other relatively heavy work devices.

BACKGROUND OF THE INVENTION AND PRIOR ART

It is well know to provide a pivotable support member pivotally secured to an upper end of the ladder as an integral ladder component. The pivotable support member is an integral component of many step ladders on the market today and is formed of wood or aluminum and serves to support small paint containers, tools and the like when pivoted into an operative position extending in a horizontal disposition. When the ladder is in storage, the support member can be pivoted to a substantially vertical disposition to occupy less space in storage. Such pivotable support members are pivotably secured to the ladder at main upstanding ladder structural members that support steps therebetween, and have no other load-bearing means capable of supporting substantial loads on the support member. Similarly, other workpiece support members or trays are available that can be attached to a ladder step to extend outwardly from the step at a pair of U-shaped clamps adapted to be positioned such that the legs of the U-shaped clamps are disposed above and below the ladder step, as the sole support for the load placed on the tray. Both the pivotable support members and removable support members described above suffer from the disadvantage that substantial loads placed upon them, particularly at substantial distances from the point of attachment to the ladder, cannot be supported sufficiently and are unstable, causing failure of the support members or insecure placement of tools or paint containers thereon. This unstable placement of paint containers, tools and the like has caused a number of tools and paint to be dropped and spilled from such support members causing substantial damage and injury.

The support member or tray of the present invention includes an adjustable load-bearing support bar or strut secured to the tray at a point spaced outwardly from the ladder, and securable to the ladder at a lower step or other lower ladder structure so that the tray can support substantial loads very stably. The tray of the present invention includes a number of other new and useful features for convenience in holding tools, paint containers, paint trays and rollers and the like that can be provided as a kit having interchangable parts for different purposes.

SUMMARY OF THE INVENTION

In brief, the present invention is directed to a new and improved support tray for a ladder, scaffold and the like that includes a load-bearing support bar or strut that is secured to ladder structure below the tray and includes means for adjusting the length of the support bar to maintain the tray in a substantially horizontal disposition for supporting paint containers, tools and the like regardless of the particular ladder step spacing or its angle of disposition a the workplace. More particularly, the present invention provides a new and improved detachable support tray adapted to be secured to and removed from a ladder and adapted to support tools, paint containers and the like in a horizontal tray member including a substantially planar floor member and integral upstanding walls. A tray member securing device or clamp is operatively connected to the tray member for securing the tray member to the ladder in a horizontal position at a predetermined height of the ladder. A strut is operatively connected to the tray member at a point on the tray member that is spaced from the tray securing device. The strut includes a pivotable ladder securing member for securing the tray member to the ladder at a height that is spaced downwardly from the tray securing device so that the tray can support substantial loads disposed within the tray member and transfer the load to the ladder structure.

Accordingly, one aspect of the present invention is to provide a new and improved support tray that can be removeably secured to a ladder, scaffold and the like for supporting paint containers, tools and the like in a substantially horizontal disposition extending outwardly and securing from the ladder in easy reach of the ladder operation.

Another aspect of the present invention is to provide a new and improved support tray for attachment to a raising device capable of raising a person above ground level such as a ladder, scaffold, and the like, wherein the support tray includes a strut angled from the sides or bottom surface of the tray and is secured to the raising device at a point spaced downwardly from the tray for improved structural support of a load held within the tray.

Another aspect of the present invention is to provide a new and improved support tray capable of being removably secured to a ladder wherein the tray can be manufactured in kit form, including a cover plate to cover a container-receiving aperture in the tray floor, and a specially designed container that fits within the floor member aperture, so that the tray can hold the container or, with the container removed and the cover plate disposed over the aperture, the tray can hold tools, paint trays or other work objects.

Another aspect of the present invention is to provide a new and improved support tray removably secured to a ladder that includes adjusting means for adjustably securing the tray to the ladder at the level of attachment of the ladder, the securing means being adjustable for movement of the tray toward and away from the ladder; and adjustable strut means for attaching the tray to the ladder at a distance below the tray, the strut means being adjustable in length to accommodate different adjusted positions of the support tray, and to accommodate different ladder structures.

BRIEF DESCRIPTION OF THE DRAWINGS

The above and other aspects and advantages of the present invention will become more apparent from the following detailed description of the preferred embodiments, taken in conjunction with the drawings, wherein:

FIG. 4 is a partially broken-away, perspective view of the support tray of FIG. 1 showing a planar support plate inserted to cover the paint container aperture for supporting tools and the like;

FIG. 5 is a partially broken-away, top view of the support tray of FIG. 1, including a paint tray attachment;

FIG. 6 is a side view of the support tray and paint tray attachment taken along the line 6—6 of FIG. 5; and FIG. 7 is a front view of an adjustable load-bearing support bar portion of the support tray of the present invention taken along the line 7—7 of FIG. 6.

DETAILED DESCRIPTION OF THE PREFERRED EMBODIMENT

Figure 1:
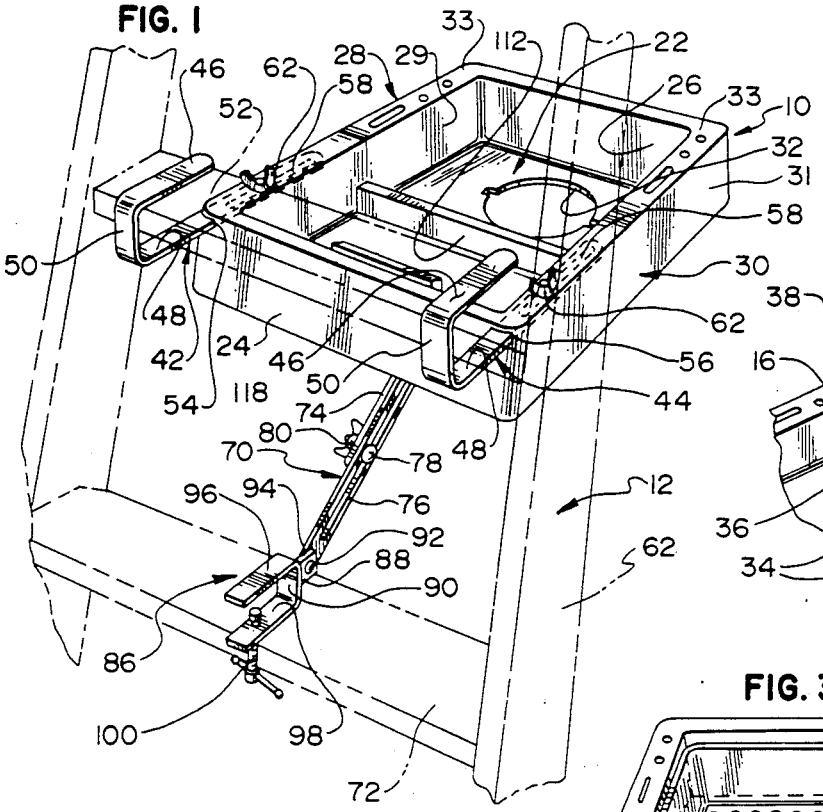
FIG. 1 is a perspective view of the support tray of the present invention secured to a ladder.

Turning now to the drawings, and initially to FIG. 1, there is illustrated a new and improved support tray, generally designated by reference numeral 10, that is removably secured to a ladder, generally designated 12, to extend outwardly from the ladder 12 for holding tools 14, paint containers generally designated 16, a paint tray, generally designated 18, and paint roller 20, and the like in a generally horizontal position convenient to the ladder user. The ladder support tray 10 includes a planar floor member, generally designated 22, integral upstanding end wall members 24 and 26 and integral upstanding side wall members generally designated 28 and 30. In the preferred embodiments of the invention shown in the drawings, the planar floor member 22 includes a circular aperture 32 for receiving a container, such as the paint container 16.

Figure 2:
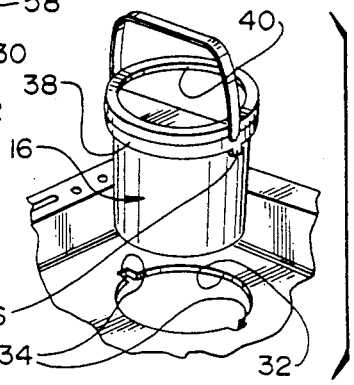
FIG. 2 is a partially broken-away perspective view of the support tray of FIG. 1 showing a specially adapted paint container fitting within a container-receiving aperture in a floor of the tray.
Figure 3:
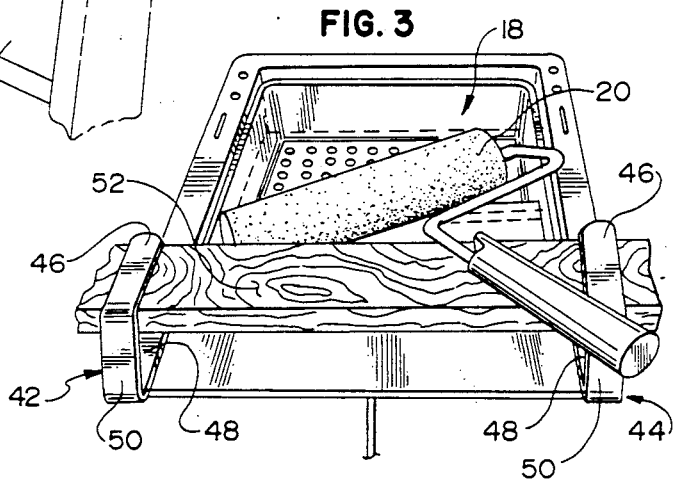
FIG. 3 is a partially broken-away, perspective view of the support tray of FIG. 1 showing a removable paint tray attachment fitted within the support tray as a modification.

As shown in FIG. 2, the aperture 32 in floor member 22 is keyed, such as with opposed notches 34 for receiving one or more keys, studs or protrusions 36 extending downwardly from an upper integral collar 38 on paint container 16. The upper collar 38 extends outwardly from an upper end of the container 16 so that when the paint container 16 is inserted into the aperture 32 of floor member 22, a lower surface of the collar 38 serves as a stop surface against an upper surface of the floor member 22 to keep the paint container within the aperture 32, without slipping through the aperture 32. The collar 38 maintains an upper paint container opening 40 near the upper surface of the floor member 22 for convenient access to the contents of the container 16. The downwardly extending protrusions 36 fit within the notches 34 to keep the paint container 16 from rotating within the aperture 32.

The support tray 10 is secured to the ladder 12 at a tray end wall 24 adjacent to the ladder 12 with two U-shaped clamps, generally designated 42 and 44. Each U-shaped clamp 42 and 44 includes an upper leg member 46 and an elongate, parallel lower leg member 48, both leg members 46 and 48 being integral with a transverse base member 50 that connects the two leg members 46 and 48. The upper and lower leg members 46 and 48, respectively, of clamps 42 and 44 are positioned, respectively, above and below a step 52 of ladder 12 to sandwich the step 52 therebetween for securing the tray 10 to the ladder 12 at the end wall 24 disposed adjacent to the ladder 12, with the opposite tray end wall 26 extending outwardly from the step 52 toward a work surface (not shown) disposed above ground level. The clamps 42 and 44 are adjustably secured within the side walls 28 and 30, respectively, of tray 10 by elongate lower leg members 48 received within side walls 28 and 30 through slots 54 and 56 in end wall 24. The side walls 28 and 30 are formed with spaced inner and outer wall members 29 and 31 respectively integral with an upper wall member 33 extending completely around the tray 10 as a continuous upper rectangular surface. The elongate lower leg members 48 are formed as planar bars having longitudionally disposed slots 58 adapted to receive a stud or bolt 60 threadedly received within wing nut 62, to secure the lower leg member 48 to the upper wall member 33 at a predetermined extent of extension of the tray 10 away from ladder step 52, and toward the work surface.

In accordance with one important feature of the present invention, loosening of wing nuts 62 permits the outward or inward movement of tray support tray 10 with respect to step 52 of ladder 12, by movement of tray 10 outwardly or inwardly along slot 58 of the elongate lower leg members 48 of clamps 42 and 44 by sliding the lower leg members 48 against an inner surface of upper wall member 30 of the side walls 28 and 30. The clamps 42 and 44 can be formed of any size or shape to accommodate any size or shape of ladder step 52. Alternatively, the clamps can be adapted to receive an upwardly extending side ladder structure 62, such as by providing apertures through the side ladder structure 62 and securing the clamps thereto with bolts and nuts, not shown.

In accordance with another important feature of the present invention, the support tray 10 includes an adjustable load-bearing support bar, generally designated 70, pivotally secured to the tray 10 at one or more locations spaced from the ladder-adjacent end wall 24, and removably secured to the ladder at one or more locations spaced below the tray 10, such as at lower step 72, disposed below step 52. The load-bearing support bar 70 is longitudionally adjustable to accommodate different distances between steps 52 and 72 of differently constructed ladders, and to accommodate the adjustment of tray 10 outwardly or inwardly from the step 52 by sliding movement of the tray 10 over the length of slots 58 in lower leg members 48 of clamps 42 and 44.

The load-bearing support bar 70 includes a pair of rigid, planar bars 74 and 76 held tightly but slidingly together with a bolt 78 and wing nut 80 and a rigid sleeve or retainer 82 that surrounds both planar bars 74 and 76 and holds the bars 74 and 76 in sliding engagement adjacent one another. Rigid bars 76 and 78 include an elongate, longitudional slot 84 for sliding engagement with bolt 78 that extends through both rigid bars 74 and 76 to adjust the length of the support bar 70. Many other constructions of support bar 70 can provide for length adjustments as well known to those of ordinary skill in the art.

A U-shaped clamp, generally designated 86, is pivotally secured to a lower end of the load-bearing support bar 70 for securing the lower end of the support bar 70 to the lower step 72 of ladder 12 after the length of the support bar has been properly adjusted via bolt 78 and wing nut 80 to securely support the tray 10 in a horizontal disposition. The clamp 86 includes an integral pivot plate 88 extending outwardly from a base portion 90 of clamp 86. A pivot pin 92 extends through the pivot plate and through a lower end of the support bar 70 to enable the clamp 86 to pivot within the plane of the support bar 70 for receiving the lower step 72 of ladder 12 while adjusting the support bar 70 to the proper length. Upper and lower leg members 96 and 98, respectively, then straddle or sandwich the lower step 72 and a clamp member 100, threadedly received in and extending through lower leg member 98, is threadedly tightened through the lower leg member 98 to secure the clamp 86 onto a lower surface 101 of the step 72. The support bar 70 provides substantial load-bearing support to the tray 10 by supporting the tray 10 in position, as shown in FIG. 6, substantially outwardly spaced from the ladder step 52.

As shown in FIG. 6, a lower surface 102 of the floor member 22 of tray 10 includes a downwardly extending pivot pin-receiving plate 104 disposed longitudionally about midway between the two end walls 24 and 26 and centrally disposed between the side walls 28 and 30 of tray 10. The support bar 70 is pivotally secured to the pivot plate 104 at its upper end 106 with a bolt 108 and wing nut 110 received through aligned apertures in the pivot plate and the upper end 106 of support bar 70.

As best shown in FIG. 1, 5 and 6, the floor member 22 of tray 10 includes an integral upwardly extending wall member 112 extending transversely completely across the tray 10 between the inner surfaces 29 of the side walls 28 and 30 of the tray 10. The wall member 112 provides two separated compartments, generally designated 114 and 116 to permit separation of various tools, paint and the like. In this manner, for example, if paint is spilled in compartment 114, it will not contact tools disposed in compartment 116. A paint tray support wall generally designated 118 also extends upwardly from and is integral with the upper surface of floor member 22, and extends upwardly higher from the floor number 22 than the wall member 112, so that an uppermost upper surface 120 of paint tray support wall 118 contacts a lower surface 122 of the paint tray, generally designated 18, for supporting the paint tray 18 in a proper horizontal position within the support tray 10, to hold a supply of paint within a reservoir portion 126 of paint tray 18 and to keep the paint 128 held within the reservoir portion 126 separated from a sloped floor member 130 of paint tray 18. Floor member 130 is sloped downwardly and outwardly toward reservoir portion 126 for contact against the paint roller 20 so that excess paint removed from roller 20 will flow by gravity back into the reservoir portion 126 of paint tray 18. The sloped floor member 130 is separated from reservoir portion 126 of paint tray 18 by an integral paint tray wall 132.

Figure 4:
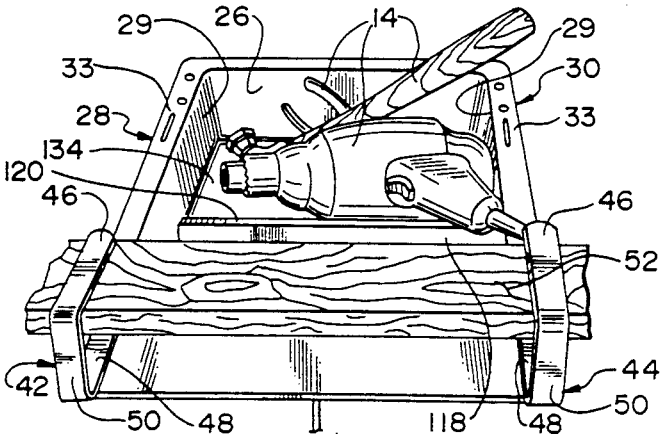

In accordance with another embodiment of the present invention, the support tray 10 can be provided to the consumer as a kit, as described above, such that the clamps 42, 44, and 86, and the load-bearing support bar 70 can be assembled easily, without tools, using the bolts and wing nuts described above. The kit can be provided with a rectangular planar plate 134 adapted to fit within compartment 126 of tray 10, shown in FIGS. 4–6, to cover the aperture 32 in floor member 22 so that the tools 14, or paint tray 18 can be held within compartment 126 of support tray 10 without concern about work items slipping through the aperture 32. The kit also can include the paint container 16, adapted to fit within aperture 32, and the paint tray 18 that fits within the support tray 10, as shown in FIG. 6.

It is thus seen that the various aspects of the invention set forth above, among those made apparent from the preceding description, are efficiently attained, and, since certain changes may be made to the described apparatus set forth without departing from the scope of the invention, it is intended that all matter contained in the above description shall be interpreted as illustrative and not in a limiting sense.

We claim:

1. A detachable support tray adapted to be secured to and removed from a ladder comprising:

a horizontally disposed tray member including a floor member having integral upstanding end walls and integral upstanding side walls, said side walls each having spaced inner and outer wall members integral with an upper wall member;

tray member securing means operatively connected to the tray member for securing the tray member to a ladder in a horizontal position at a predetermined height of the ladder, said securing means comprising two U-shaped clamps, each clamp including a planar, elongated leg member received in a side wall of the tray between said spaced inner and outer wall members adjacent to said upper wall member for supporting the tray in a horizontal disposition;

means for securing an upper planar surface of each elongated leg member to an inner surface of an upper wall member; and strut means operatively and pivotably connected to the tray member at a point on the tray member spaced from the tray member securing means, said strut means including a ladder securing member pivotably connected thereto and pivotable independently from the pivotable connection of the strut means to the tray member, for securing the tray member to the ladder at a height that is spaced downwardly from the tray member securing means and adapted to bear a load disposed within the tray member and transfer said load to the ladder.

2. The support tray of claim 1 wherein each elongated leg member is slideably secured to the tray member such that the elongated leg members can be adjustably positioned with respect to the tray member for contacting and supporting different lengths of the tray member.

3. The support tray of claim 2 wherein a portion of each elongated leg member contacts its adjacent inner and outer wall members over a portion of the length of said side walls.

4. The support tray of claim 1 wherein the floor member of the support tray defines an aperture adapted to receive a container.

5. The support tray of claim 4, further including a substantially planar plate disposed to overlie the aperture for supporting work objects thereon.

6. The support tray of claim 1 wherein the floor member is substantially planar and includes an upstanding wall member extending substantially vertically upwardly and transversely between parallel upstanding tray member side wall members to separate the support tray into a plurality of separate compartments.

7. An adjustable support tray adapted to be secured to a raising means for raising a human being above ground level and having improved structural support for carrying heavy objects used above ground level comprising:

a horizontally disposed support tray operatively connected to said raising means such that the support tray extends substantially horizontally outwardly from said raising means toward a work surface, said work surface disposed above ground level;

connecting means operatively disposed to connect the support tray to said raising means for connecting the support tray to the raising means; and adjustable strut means operatively and pivotably connected to the support tray on one strut means end and operatively connected to the raising means by a ladder securing member pivotably connected to the other strut means end, said strut means being adjustable in length for connecting the support tray to the raising means at differing distances below the support tray and such that the adjustable strut means is adapted to connect to the raising means at differing angles with respect to a horizontal plane of the support tray.

8. The support tray of claim 7 wherein the support tray connecting means includes means for adjustably connecting the support tray to the raising means such that the support tray is adjustable outwardly from the raising means toward and away from the work surface while the support tray is securely connected to the raising means.

9. The support tray of claim 7 wherein the support tray includes a planar floor member integral with an upstanding wall member that extends upwardly from the floor member.

10. The support tray of claim 9 further including an aperture in the floor member adapted to receive a container therein.

11. The support tray of claim 9 further including a paint tray received within the wall member and supported by the floor member, said paint tray including a floor member disposed above the support tray floor member; said paint tray further including upstanding wall means integral with the paint tray floor member and disposed adjacent to the support tray wall member for containing paint within the paint tray; said paint tray floor member being angled from the horizontal downwardly and outwardly in a direction away from the raising means when the support tray and paint tray are operatively positioned on the raising means.

12. The support tray of claim 9 further including a separating means extruding upwardly from the floor member and operatively connected to the wall member to separate the floor member into a plurality of separate compartments.

13. A support tray kit adapted for assembly by a user, comprising:

a tray member including a floor member having an integral upstanding walls;

a pair of first U-shaped clamp members adapted to be attached to both the tray member and to a ladder;

an adjustable elongate support means, adapted to be pivotably secured, to both the tray member and a ladder, below the tray member floor member;

a second U-shaped clamp member having means adapted to be pivotably secured to the elongate support means;

means for securing the first U-shaped clamp members to the tray member;

means, for pivotably securing the adjustable elongate support means to the tray member, on the lower surface of the tray member floor member and at one end of the support means;

means for pivotably securing the adjustable elongate support means to the second U-shaped clamp member at the opposite end of the support means; and means for securing the second U-shaped clamp member to a ladder.

14. The kit of claim 13 wherein the floor member includes an aperture for receiving a paint container, and further including:

a planar plate adapted to fit over the aperture in the floor member of the support tray; and a paint tray adapted to fit over the floor member aperture.

15. The support tray kit of claim 14 further including a container adapted to be received within said aperture, said container including an integral collar member surrounding an upper portion of the container, said collar including a planar lower stop surface adapted to contact a floor member surface peripherally surrounding the aperture to maintain the container in position within the aperture.

16. The support tray kit of claim 15, wherein the floor member aperture includes a notch and the collar member includes a protrusion shaped cooperatively with the notch such that the protrusion is received within the notch to prevent rotation of the container within the aperture.

* * * * *